US006386533B1

(12) United States Patent
Chakrabarti et al.

(10) Patent No.: US 6,386,533 B1
(45) **Date of Patent: *May 14, 2002**

(54) LASER PROCESSING FIXTURE

(75) Inventors: Utpal Kumar Chakrabarti, Allentown, PA (US); David Reese Peale, Chatham, NJ (US)

(73) Assignee: Agere Systems Guardian Corp., Orlando, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/071,499

(22) Filed: May 1, 1998

(51) Int. Cl.[7] ..... B25B 1/20
(52) U.S. Cl. ..... 269/43; 269/277; 269/156
(58) Field of Search ..... 269/43, 21, 247, 269/254 CS, 259, 271, 277, 156

(56) References Cited

U.S. PATENT DOCUMENTS 2,529,452 A * 11/1950 Jane et al. ..... 269/254 CS
4,874,156 A * 10/1989 Goldzweig ..... 269/254 CS
4,995,539 A 2/1991 Richard
5,154,333 A 10/1992 Bauer et al.
5,163,664 A * 11/1992 Calaio ..... 269/259
5,551,676 A * 9/1996 Tibbet ..... 269/43
5,553,837 A * 9/1996 Kahle ..... 269/21
5,564,682 A * 10/1996 Tsuji ..... 269/21
5,660,380 A * 8/1997 Reis et al. ..... 269/21
5,683,077 A * 11/1997 Fink et al. ..... 269/43
5,719,077 A 2/1998 Chakrabarti et al.
5,893,551 A * 4/1999 Cousins et al. ..... 269/43

* cited by examiner

*Primary Examiner*—Derris H. Banks
*Assistant Examiner*—Lee Wilson
(74) *Attorney, Agent, or Firm*—Wendy W. Koba

(57) ABSTRACT

A laser processing fixture is formed to allow for facet processing of cleaved laser bars, either individually, or allowing for multiple bars to be processed simultaneously. The fixture holds the bars at a precisely-controlled distance with respect to a predefined reference plane, and holds the bars rigidly enough so as to minimize the possibility of vibration, but not so forcefully as to cause damage. The fixture comprises a fixed jaw and a movable jaw, with a pair of spaced-apart support members extending between the jaws. One or more laser bars may then be positioned between the jaws such that the front and rear facets will be exposed above and below the jaws. Therefore, each facet may be processed without unloading and re-loading the bars in the fixture. The support members, which may comprise a pair of wires, are spaced a sufficient distance so as to be disposed beyond the location of any active device region. In an arrangement for processing multiple bars, the support members may be formed as rails (with or without vacuum pull-down slots) and spacer elements may be interposed between adjacent bars to prevent facet coatings from bridging between adjacent laser bars.

14 Claims, 6 Drawing Sheets

LASER PROCESSING FIXTURE

BACKGROUND OF THE INVENTION

The present invention relates to a compact laser processing fixture and, more particularly, to a fixture for holding one or more laser bars such that the front and rear facets of the individual laser devices on the bars remain exposed for further processing, such as facet coating or focused ion beam milling.

During the manufacture of laser devices there are certain processing steps that are to be performed on the front and rear facets of the individual devices. For ease of manufacture and process uniformity, these steps are best performed when the laser is in "bar" form, that is, subsequent to the step of cleaving a wafer into separate, rectangular-shaped "bars". Each bar may include, for example, a dozen or more individual laser devices formed along its length.

One set of processes that is best performed at this stage of fabrication is facet coating. The laser "facets" may be defined as the front and rear surfaces of the individual laser devices that are exposed by the wafer cleaving process. To form active devices, these facets are coated with, for example, a dielectric material with proper reflectivity properties. For optimum performance of an individual device, as well as all devices within a particular process batch run, these coatings should be as uniform as possible (both at the device level, as well as from device to device within a particular process run). Further, the laser bars need to be "held" during the coating process such that the material being deposited as the coating may or may not overflow (as desired) onto the top or bottom surfaces. Other process steps, besides facet coating, are also best performed when the laser is in "bar" form. For example, any process that includes physical modification of the facet itself, such as by focused ion beam milling (see, for example, U.S. Pat. No. 5,625,617, "Near-Field Optical Apparatus with Laser having a non-uniform emission face), is best performed before a laser bar is cleaved into individual devices. During an exemplary focused ion beam process, the features being introduced onto the facet surface may be as small as 5–10 nm. Therefore, the laser bar must be held at a precisely specified uniform height, as well as held in a manner that minimizes the potential for vibration of the bar(s). Additionally, since an exemplary laser bar is itself relatively small and fragile (on the order of 1 cm in length, 0.75 mm tall and about 0.1 mm thick), any fixturing used to hold the laser bar during processing must be able to hold the bar firmly and reliably, but without damage. Lastly, to provide for the most efficient processing, the laser fixturing apparatus should, in most situations, be able to hold multiple bars simultaneously within a single processing fixture.

SUMMARY OF THE INVENTION

These and other requirements of laser fabrication are addressed by the present invention, which relates to a compact laser processing fixture and, more particularly, to a fixture for precisely and rigidly holding one or more laser bars such that the front and rear facets of the individual laser devices on the bars remain exposed for further processing.

In accordance with the present invention, a laser processing fixture is formed to comprise a first, stationary jaw and a second, movable jaw. A pair of bar-support members are disposed underneath and extend between the jaws in a spaced-apart relationship. In accordance with the present invention, the movable jaw is normally pressed towards the stationary jaw by a spring member, but is also retractable by an external means to allow for one or more laser bars to be positioned between the jaws such that a facet of the bar rests upon the bar support members. In a preferred embodiment of the present invention, the bar support members are spaced a sufficient distance apart such that the portions of the bar that contact the bar support members are beyond the locations of the active laser devices within the laser bar. Once the bars are loaded, the external retraction mechanism is released and the movable jaw is pressed forward by the spring member to contact the exposed top (or bottom) surface of the laser bar. It is an advantage of the design of the present invention that the fixture will hold the bar facets at a precisely-controlled distance with respect to a predefined reference plane. This control is particularly required for operations such as focused ion beam milling, where the facet plane must lie within the narrow focal plane window of the focused ion beam.

It is a feature of the arrangement of the present invention that both the front and rear facets of the laser bar are simultaneously exposed, thereby limiting the amount of unloading and re-loading that needs to be performed during laser bar processing. Additionally, it is an aspect of the present invention that the bar support members are capable of being controlled by a positioning arrangement such that precise alignment of the laser bar with respect to the jaws/fixture may be achieved.

In one embodiment of the present invention, the bar support members may comprise a pair of tungsten wires. Alternatively, the bar support members may comprise a pair of vacuum-slotted support rails, where this alternative embodiment is useful in processing multiple laser bars. In an embodiment for processing multiple wafer bars, additional spacer elements of a predetermined geometry may be disposed between adjacent bars to allow for ease of separation of the laser bars subsequent to processing, as well as to either permit or prevent "wrap around" of the facet dielectric coating.

Other and further features and aspects of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
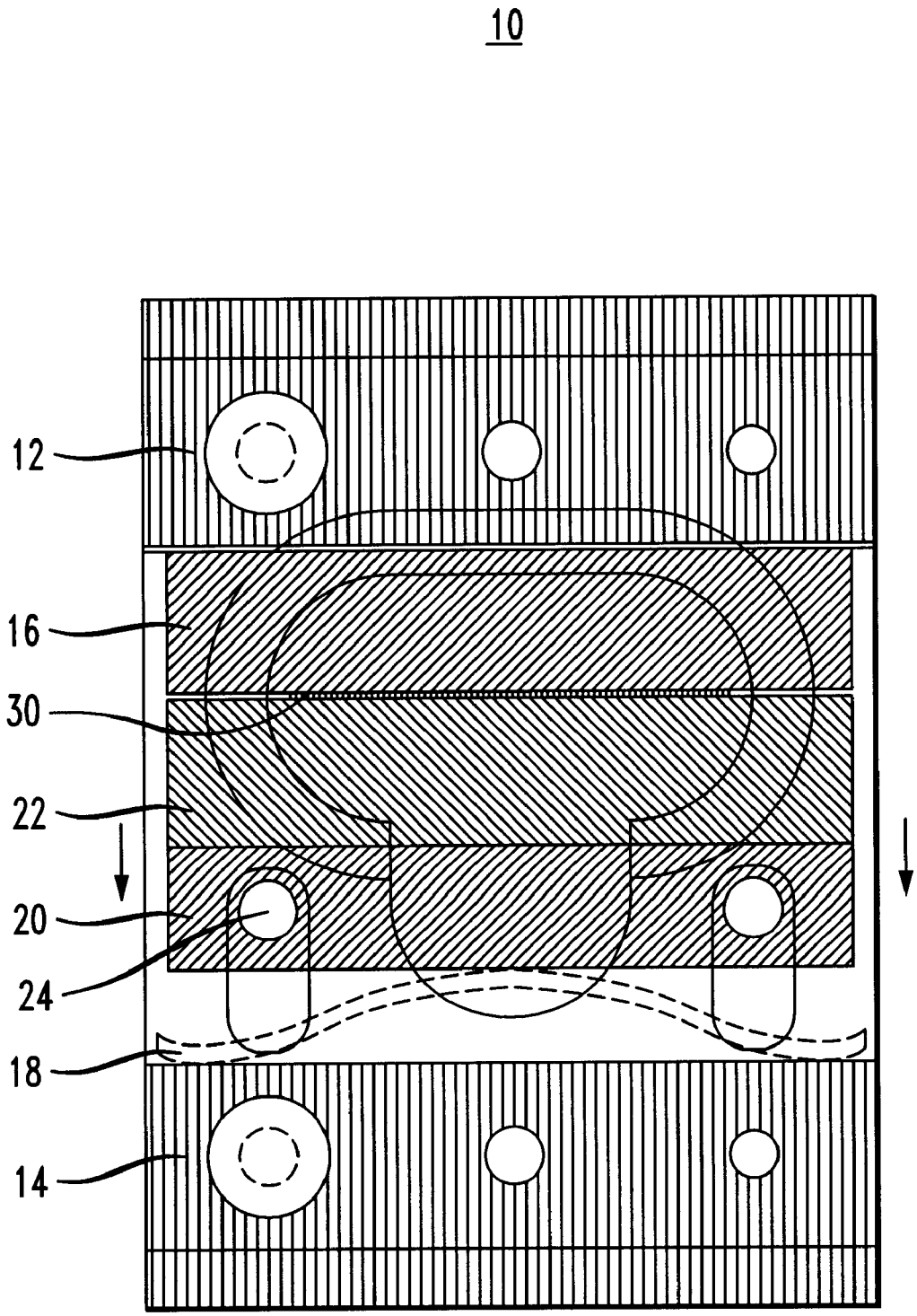
FIG. 1 is a top view of an exemplary laser processing fixture formed in accordance with the present invention.

FIG. 1 contains a top view of an exemplary laser processing fixture 10 formed in accordance with the present invention. Fixture 10 comprises a pair of body spacer plates 12 and 14 that remain motionless and define the outer walls of fixture 10. A stationary jaw 16 is positioned next to and in contact with first body spacer plate 12. A spring member 18, such as a leaf spring, is positioned next to and in contact with second body spacer plate 14. In a preferred embodiment, spring element 18 is formed of a relatively strong metal, such as tungsten, although any other suitable material may be used. A release plate 20 including a movable jaw 22 is disposed next to and in contact with the opposite side of spring member 18. A retraction means 24, such as a pair of apertures, is formed in release plate 20 to allow for movement of movable jaw 22 in the direction indicated by the arrows in the Z direction in FIG. 1. In the fully released state, as illustrated in FIG. 1, a gap 26 remains between adjacent surfaces of stationary jaw 16 and movable jaw 22. Spring element 18 applies a predetermined pressure to movable jaw 22 sufficient to capture a laser bar between the jaws without damaging the surfaces of the laser bar.

Figure 2:
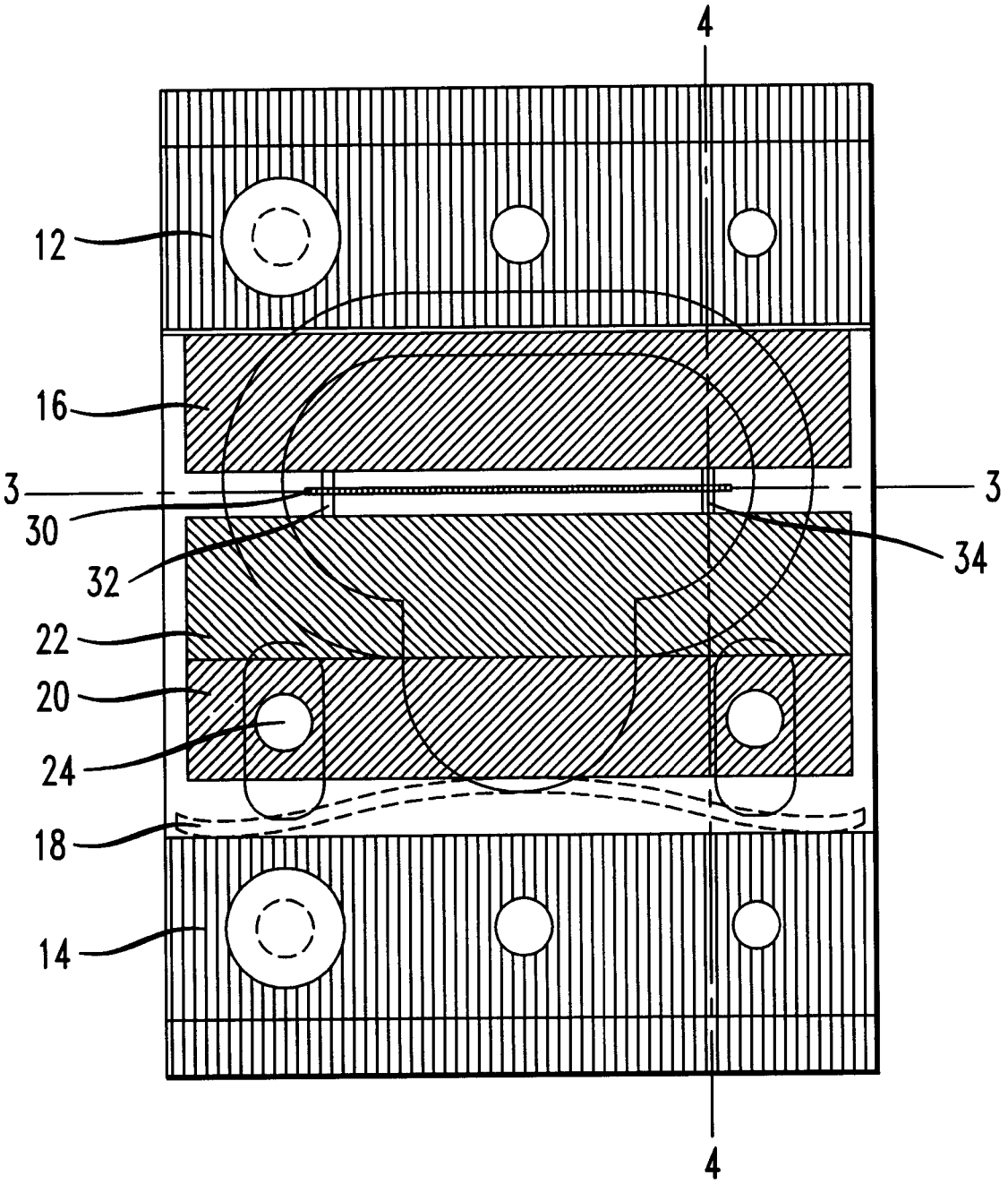
FIG. 2 is a top view of the exemplary laser processing fixture of FIG. 1, with the movable jaw held in its retracted position.
Figure 3:
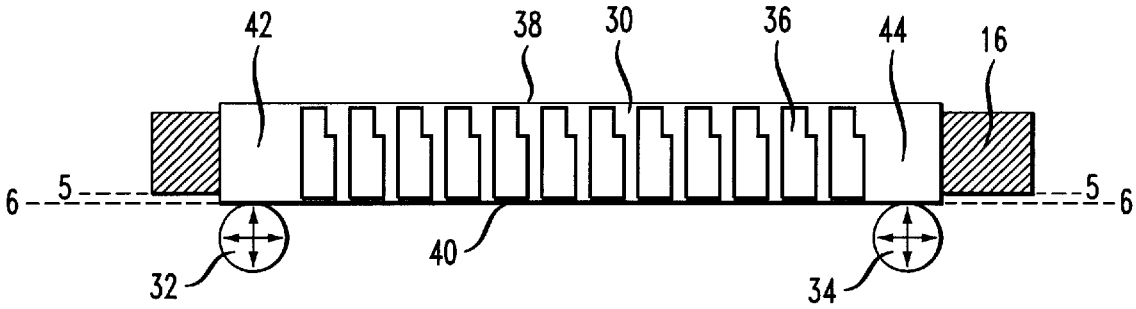
FIG. 3 is a cut-away side view of the laser processing fixture, taken along line 3—3 of FIG. 2.

FIG. 2 illustrates fixture 10 in the fully retracted position, with spring member 18 being flattened between second body spacer plate 14 and release plate 20. The retracted position allows for one or more laser bars to be loaded into fixture 10. An exemplary laser bar 30 is illustrated in phantom in FIG. 2, where laser bar 30 is shown as resting upon a pair of bar support members 32, 34 disposed in a spaced-apart relationship below and extending between stationary jaw 16 and movable jaw 22. Bar support members 32,34 do not need to be permanently attached to jaws 16,22, and in a preferred embodiment are removed once the laser bars are loaded in fixture 10. FIG. 3 is a cut-away side view of fixture 10 illustrating an exemplary laser bar 30 resting on spaced-apart bar support members 32 and 34. A plurality of active devices, exemplified by contact regions 36 are illustrated as formed on laser bar 30. When laser bar 30 was cleaved from a wafer during processing (not shown), front and rear facets 38 and 40, respectively, were formed. Since laser bar 30 is held on its side in fixture 10, both front facet 38 and rear facet 40 are exposed for further processing. Advantageously, laser bar 30 includes end regions 42, 44 that do not contain active devices. Therefore, support members 32 and 34 may rest against rear facet 40 (or alternatively, front facet 38) at end regions 42,44 without directly contacting any active device.

Figure 4:
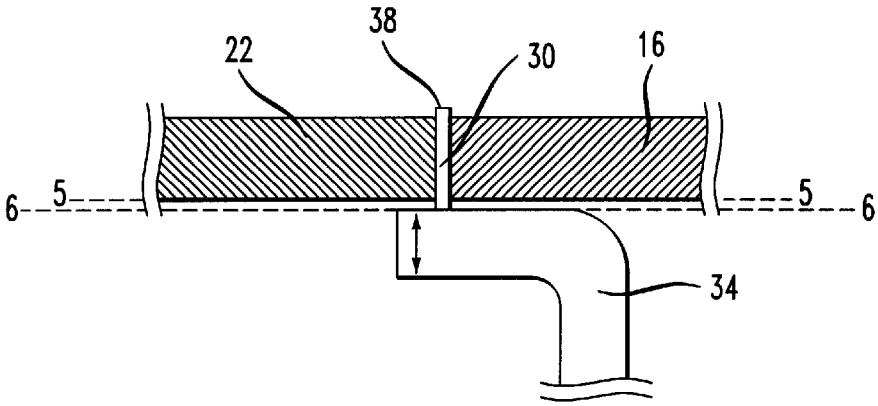
FIG. 4 is cut-away side view of the laser processing fixture, taken along line 4—4 of FIG. 2.

FIG. 4 is an alternative side view of the arrangement of the present invention, illustrating laser bar 30 as held between stationary jaw 16 and movable jaw 22. As shown in this view, bar support member 34 comprises a wire, where the circular cross section of wire 34 is evident in the view illustrated in FIG. 3. In particular, tungsten wires may be used. As mentioned above, an aspect of the arrangement of the present invention is that bar support members 32,34 are movable (as indicated by the directional X and Y direction arrows in FIGS. 3 and 4) so as to affect proper alignment of facets 38 and 40 with the mechanical reference plane of processing fixture 10. In order for proper coating or facet processing to be performed, it is necessary that the laser bar be aligned as precisely as possible. Bar support members 32,34 may be, in turn, attached to any type of well-known micro-positioning platform capable of providing movement in the necessary X, Y and Z directions. It is an advantageous feature of the design of the fixture and the associated bar support members that the spatial relation between the laser facet planes and the mechanical reference plane 5—5 during bar loading is highly reproducible (for example, ≦0.001") from fixture to fixture and run to run.

Figure 5:
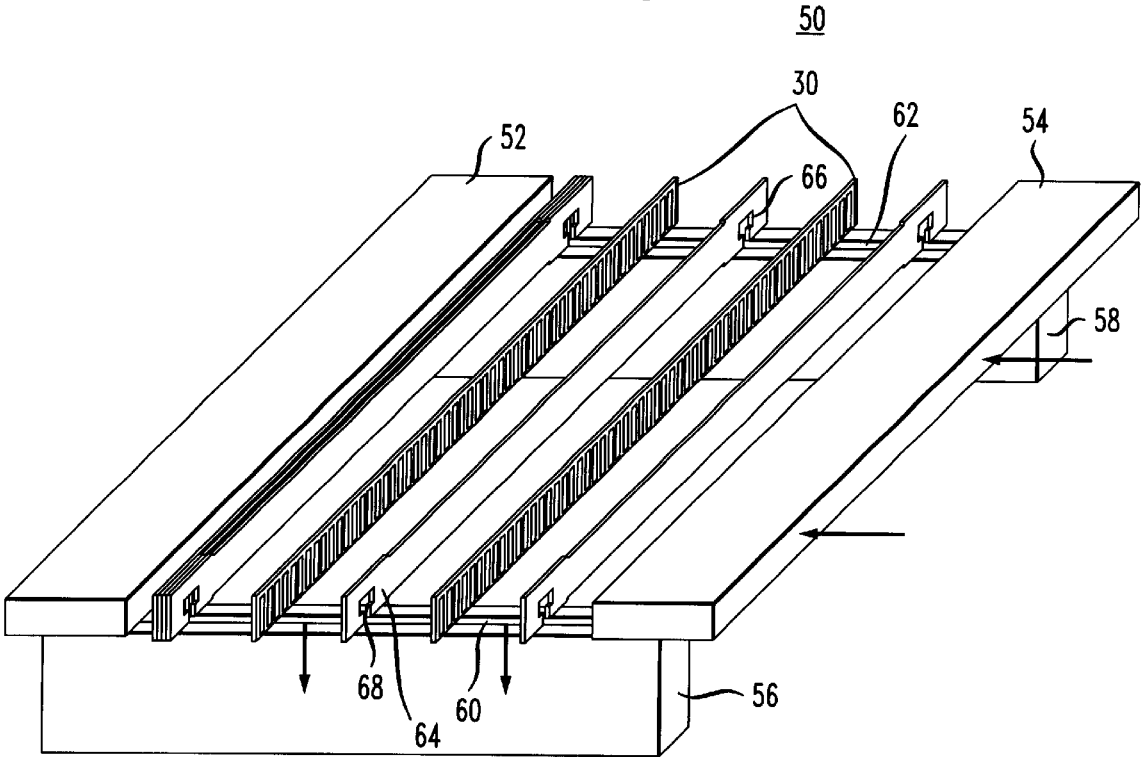
FIG. 5 is an isometric view of an alternative embodiment of the present invention, illustrating an arrangement for processing a plurality of laser bars.

An alternative embodiment of the present invention is illustrated in isometric form in FIG. 5. In particular, a laser processing fixture 50 capable of simultaneously processing a plurality of laser bars is shown. Similar to the arrangement discussed above, fixture 50 includes a stationary jaw 52 and a movable jaw 54 (the associated body spacer plates, retracting means, and spring member are not shown in this embodiment for the sake of clarity). A pair of bar support members 56 and 58 are shown as disposed below jaws 52 and 54 in a spaced-apart relationship. In the embodiment of FIG. 5, bar support members 56 and 58 comprise a pair of vacuum-slotted support rails. In particular, as shown in FIG. 5, support rail 56 includes a vacuum slot 60 that pulls air downward, as shown by the arrow in FIG. 5. Similarly, support rail 58 includes a vacuum slot 62. A plurality of N laser bars 30 are loaded as shown between jaws 52 and 54, where as discussed above, the end regions of each bar rest upon support members 56 and 58.

An advantage of simultaneously processing a plurality of laser bars is that the packing density is significantly increased, ensuring a more uniform distribution of coating material across the exposed facet surfaces of each bar. Further, there is an economic advantage in processing as many bars as possible during a single coating operation. In such instances where a plurality of laser bars are being coated, there may be a problem separating one bar from another, that is, the coating may bridge from one laser bar to the adjacent laser bar. Therefore, in accordance with the present invention, a plurality of spacers 64 may be used and interleaved with adjacent laser bars, as shown in FIG. 5, so as to maintain a predetermined distance between adjacent laser bars. Spacers 64 may be formed of a material to which the process coating will not adhere, such as a plastic. Therefore, when movable jaw 54 is retracted to allow for removal of processed laser bars 30, spacers 64 will naturally separate one laser bar from another.

Figure 6:
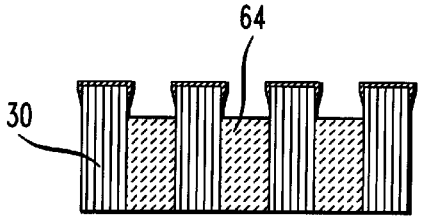
FIG. 6 illustrates an exemplary set of laser bars and associated spacer elements where the spacer elements are formed to be slightly shorter than the laser bars.

In one embodiment of the present invention utilizing spacers 64, the spacers are designed to include notched end portions 66,68, where these portions align with vacuum slots 60 and 62, respectively. The notched end portions form a channel with vacuum slots 60 and 62 and thereby aid in holding laser bars 30 motionless during loading of the bars, as well as serving to pull all of the bars into uniform registry against the support rails. In design, spacers 64 may be formed to comprise a height essentially identical to laser bars 30 so as to form an essentially planar surface for the facet coating process. Alternatively, spacers 64 may be formed to be slightly shorter than the adjacent laser bars 30. In this arrangement, any applied facet coating will also coat the exposed edge portions of each laser bar, as shown in FIG. 6. There are instances where such a "wrap around" coating is desired and the fixture of the present invention is convenient to perform such processing.

Figure 7:
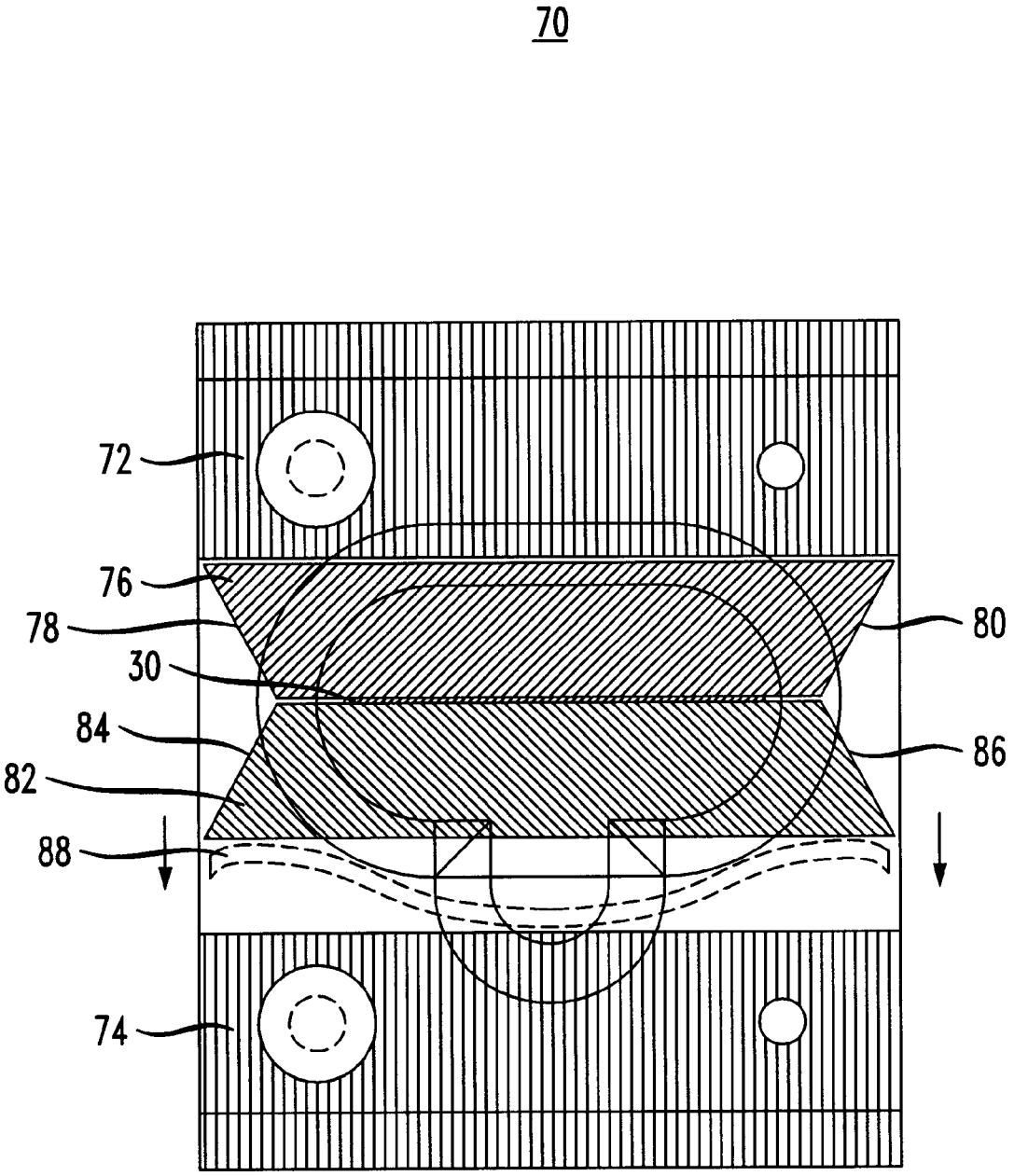
FIG. 7 is a top view of yet another embodiment of the present invention, illustrating an alternative jaw geometry.

Various other modifications are possible in the geometry of the piece parts forming the laser bar processing fixture of the present invention. FIG. 7 illustrates one such alternative geometry. Laser processing fixture 70 comprises a pair of body spacer plates 72 and 74 that remain motionless and define the outer walls of fixture 70. A stationary jaw 76 is positioned next to and in contact with first body spacer plate 72. Unlike the arrangements described above, stationary jaw 76 comprises a pair of inwardly tapering sidewalls 78,80, where the tapered arrangement will be discussed below in association with a discussion of the retraction mechanism of fixture 70. A movable jaw 82 is positioned next to stationary jaw 76 and includes inwardly tapering sidewalls 84, 86. A spring member 88 is disposed between movable jaw 82 and second body spacer plate 72. Similar to the arrangements discussed above, spring member 88 is used to urge movable jaw 82 in the direction of stationary jaw 76, while holding motionless the laser bars disposed between the jaws.

Figure 8:
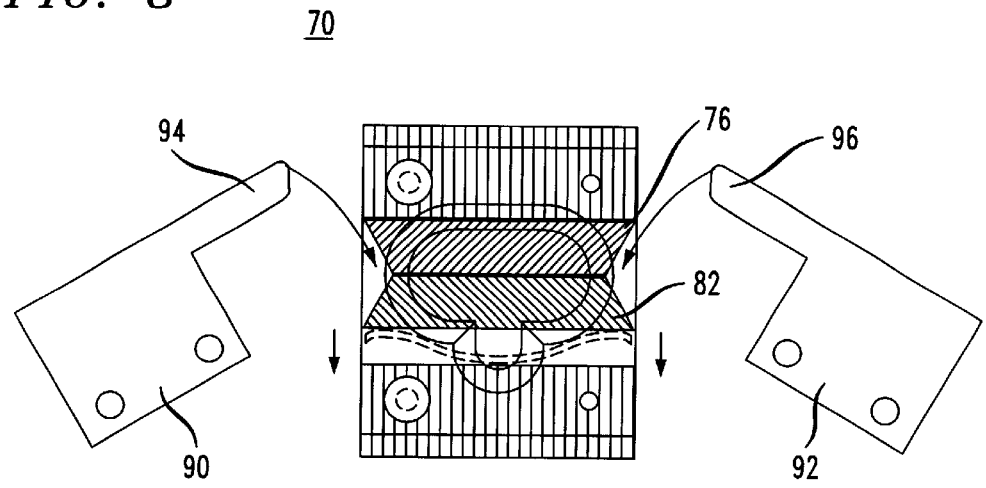
FIGS. 8–10 contain top views of the embodiment of FIG. 7, illustrating an exemplary retraction/release means for separating the movable jaw from the stationary jaw to effect laser bar loading.
Figure 9:
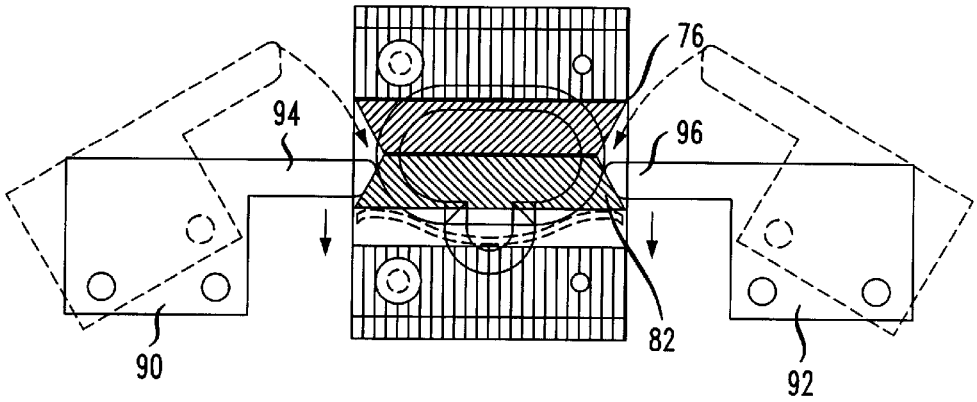
Figure 10:
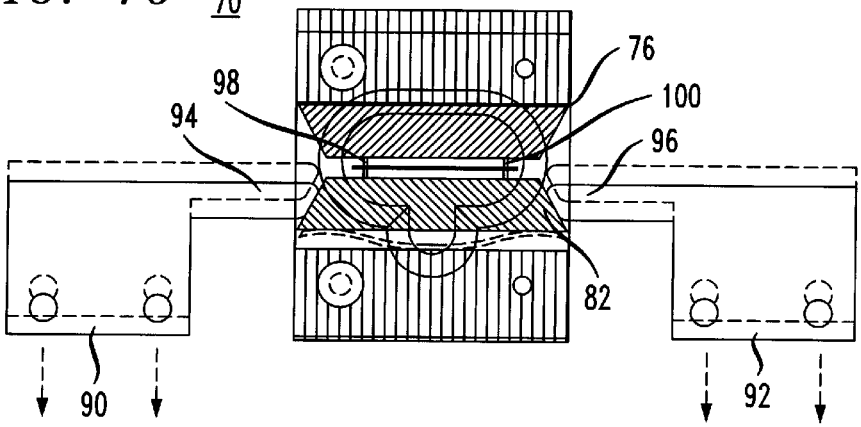

In this alternative embodiment of the present invention, the retraction means comprises a pair of external release mechanisms that engage the tapered sidewall areas between the jaws. FIGS. 8–10 illustrate the operation of an exemplary external release mechanism with fixture 70 as described above. Referring to FIG. 8, a pair of release plates 90 and 92 are disposed on either side of fixture 70. Release plate 90 includes an extended finger portion 94 and, similarly, release plate 92 includes an extended finger portion 96. The arrows included in FIG. 8 illustrate the direction that release plates 90,92 can rotate so as to allow for finger portions 94,96 to enter the areas adjacent to the tapered sidewalls of jaws 76 and 82. FIG. 9 illustrates the arrangement with finger portions 94,96 filly engaged with fixture 70 such that finger portion 94 is in physical contact with sidewall 84 of movable jaw 82 and finger portion 96 is in physical contact with sidewall 86 of movable jaw 82. Movable jaw 82 is then separated from stationary jaw 76 by the movement of release plates 90,92 toward body spacer plate 72, as shown in FIG. 10. Once movable jaw 82 has been displaced a sufficient amount, a pair of spaced-apart support members 98,100 are visible, and laser bars may be loaded to rest upon support members 98 and 100 in the manner described above. After all available laser bars are loaded, the operations illustrated in FIGS. 8–10 are performed in reverse order so to release movable jaw 82 and allow it to be urged against the loaded bars, where spring member 88 will maintain a sufficient force against jaw 82 such that the bars will remain motionless.

It is to be understood that the fixture of the present invention is useful in various laser bar processing operations. For example, focused ion beam processing may be used to modify the shape of one of the laser facets. The focused ion beam process requires resolution on the order of 5–10 nm to provide accurate facet shaping, where this resolution necessitates that the laser bar be held essentially motionless. The design of the present invention provides such rigidity. Further, the focused ion beam process depends upon the beam remaining in perfect focus over the length of the entire bar as each device facet is separately formed. The availability of the reproducible mechanical reference plane and the capability of the support member adjustment during bar loading of the present invention permits each bar to be precisely alignment to the mechanical reference plane of the laser processing fixture prior to initiating the focused ion beam process.

Other and further uses for the laser processing fixture of the present invention will be apparent to those skilled in the art and are considered to fall within the spirit and scope of the present invention as defined by the following claims.

What is claimed is:

1. A laser processing fixture for supporting at least one laser bar, the laser bar defined as comprising a plurality of active devices being formed therein and including opposing front and rear facets with top and bottom contact surfaces formed therebetween, said fixture comprising:

a pair of body spacer plates that remain motionless and define the outer walls of said laser processing fixture a stationary jaw member positioned next to a first body spacer plate;

a movable jaw member;

a pair of support members disposed below said stationary jaw member and said movable jaw members, said support members positioned in a spaced-apart relationship for allowing simultaneous processing of the opposing front and rear facets of said least one laser bar; and a spring member disposed between said movable jaw member and a second body spacer plate to retract an amount sufficient to allow for laser bars to be positioned between said stationary jaw and said movable jaw wherein positioned laser bars would rest upon the pair of support members, said spring member, upon release, causing said movable jaw to move towards said stationary jaw and hold in place any laser bars positioned therebetween.

2. A laser processing fixture as defined in claim 1 wherein the spring member comprises a leaf spring.

3. A laser processing fixture as defined in claim 1 wherein the fixture further comprises a pair of spacer elements for supporting the stationary jaw and movable jaw, the stationary jaw attached directly to a first spacer element of the pair of spacer elements and the spring member disposed between the movable jaw and the remaining spacer element of said pair of spacer elements.

4. A laser processing fixture as defined in claim 1 wherein the pair of support members comprise a pair of wires.

5. A laser processing fixture as defined in claim 4 wherein the wires comprise tungsten.

6. A laser processing fixture as defined in claim 1 wherein the pair of support members comprise a pair of support rails, each rail including a lengthwise slot for drawing a vacuum therethrough so as prevent motion of any laser bar resting upon said pair of support members.

7. A laser processing fixture as defined in claim 1 wherein said fixture further comprises a plurality of spacer elements to allow for the processing of a plurality of laser bars, each element for being disposed between adjacent laser bars positioned within said fixture.

8. A laser processing fixture as defined in claim 7 wherein each spacer element is formed to comprise a height essentially identical to a plurality of laser bars to as form an essentially planar surface with the facet surfaces of said plurality of laser bars.

9. A laser processing fixture as defined in claim 7 wherein each spacer element is formed to comprise a height less than the height of a plurality of laser bars.

10. A laser processing fixture as defined in claim 1 wherein the fixture further comprises retraction means coupled to the movable jaw for effecting the movement of said movable jaw away from the stationary jaw so as to allow for laser bars to be loaded to rest upon the pair of support members.

11. A laser processing fixture as defined in claim 10 wherein the retraction means comprises at least one aperture formed in the movable jaw sufficient to allow for said movable jaw to be pulled away from the stationary jaw member.

12. A laser processing fixture as defined in claim 10 wherein the retraction means comprises a first release plate foe engaging a first sidewall of the movable jaw; and a second release plate for engaging a second, opposite sidewall of said moveable jaw, said first and second release plates for pulling said movable jaw away from the stationary jaw to allow for laser bars to be loaded.

13. A laser processing fixture as defined in claim 12 wherein the stationary jaw comprises inwardly tapering sidewalls; and the movable jaw comprises inwardly tapering sidewalls, the first and second release plates engaging the tapered ends of the movable jaw sidewalls.

14. A laser processing fixture as defined in claim 1 wherein the pair of support members is removable.

* * * * *